US005506668A

United States Patent [19]

Guth

[11] Patent Number: 5,506,668

[45] Date of Patent: Apr. 9, 1996

[54] IMAGE FORMING APPARATUS HAVING TONER REMOVING DEVICE

[75] Inventor: Joseph E. Guth, Holley, N.Y.

[73] Assignee: Eastman Kodak Company, Rochester, N.Y.

[21] Appl. No.: 186,210

[22] Filed: Jan. 25, 1994

[51] Int. Cl.[6] ..... G03G 21/00

[52] U.S. Cl. ..... 355/296; 355/210; 355/326 R

[58] Field of Search ..... 355/296, 297, 355/301, 303, 326 R, 327, 328, 200, 210

[56] References Cited

U.S. PATENT DOCUMENTS

| | | | |
|---|---|---|---|
| 4,479,709 | 10/1984 | Syukuri et al. | 355/296 |
| 4,639,124 | 1/1987 | Nye, Jr. et al. | 355/297 |
| 4,650,311 | 3/1987 | Mayer | 355/296 |
| 4,660,503 | 4/1987 | Jones | 118/645 |
| 4,705,387 | 11/1987 | Lin | 355/303 |
| 4,778,740 | 10/1988 | Takashima et al. | 430/42 |
| 4,797,708 | 1/1989 | Kasiske et la. | 355/296 |
| 5,001,028 | 3/1991 | Mosehauer et al. | 430/45 |
| 5,225,880 | 7/1993 | Shehata et al. | 355/296 |
| 5,278,621 | 1/1994 | Okamoto et al. | 355/296 X |

OTHER PUBLICATIONS

U.S. patent application Ser. No. 08/065,246, filed May 20, 1993, Guth et al.

EP Patent Application 0 399 478, filed 22 May 1990.

*Primary Examiner*—Sandra L. Brase

*Attorney, Agent, or Firm*—Leonard W. Treash, Jr.

[57] ABSTRACT

Image forming apparatus forms first and second toner images in the same portion of an image member. To prevent scavenging of toner in the first image into a second toning station, lightly held toner in the first image is removed from the image member prior to the second toning station.

6 Claims, 2 Drawing Sheets

IMAGE FORMING APPARATUS HAVING TONER REMOVING DEVICE

This invention relates to an image forming apparatus in which two or more toner images are formed in a single frame or area of an image member. Although not limited thereto, it is particularly usable in forming accent color images on a single frame of an image member.

U.S. Pat. No. 5,001,028 to Mosehauer et al is representative of a number of references describing a process in which a photoconductive image member is uniformly charged and imagewise exposed to create an electrostatic image. Toner is applied to the electrostatic image to create a toner image. Usually, in this process, discharged area development is used. Thus, the toner applied is of the same polarity as the electrostatic image. It deposits in the areas of lowest charge (the discharged areas) to form a toner image having a density which is greatest in the portions of the image receiving the greatest exposure.

Although not absolutely necessary in this process, the image member is, again, uniformly charged with a charge of the same polarity as the original charge. It is, again, imagewise exposed to form a second electrostatic image, generally in the portions of the image member not covered by the first toner image. The second electrostatic image is toned, again, with a toner of the same polarity as the charge to create a second toner image. The process can be repeated with a third electrostatic image to create a third toner image. The three toners can be of different colors to create a three color image, or more. The two (or more) color image is transferred in a single step to a receiving sheet and fused also in a single step.

Although the process is not necessarily limited to such applications, it is most commonly used to provide accent color prints or copies with laser or LED printhead electronic exposure. Commercial applications commonly use electronic exposure and discharged area development.

The process has a number of advantages in accent color applications. It eliminates the troublesome and expensive steps usually used in registering images at transfer. If it uses separate exposure stations, it can produce accent color output at the same speed as single color output.

It is important that the second and subsequent toning steps not disturb the first toner image. Otherwise, toner from the first toner image gets mixed into the second development station ("scavenging") and toner from the second development station can be deposited on the first toner image ("overtoning"). Recharging between images reduces overtoning.

U.S. Pat. No. 4,778,740 to Takashima et al, Oct. 18, 1988, notes a problem observed in such systems. When the second electrostatic image includes discharged areas immediately next to the first toner image, the first toner image has a tendency to migrate into the second image. The solution suggested is to leave a one pixel gap between the first image and the second exposure. This can be accomplished in an electrostatic exposure system providing registration between the two exposures is very accurate. However, it requires excellent registration and leaves a thin, untoned area between the two images which can show up as a white streak or "halo".

U.S. patent application Ser. No. 08/065,246 filed to Guth et al, METHOD OF FORMING TWO TONER IMAGES IN A SINGLE FRAME, May 20, 1993, describes other solutions to the problem of migration of the first toner image into the second electrostatic image. One solution included discharging portions of the image member under the first toner image when creating the second electrostatic image. It is also suggested that scavenging can be reduced by using a smaller particle size toner in the first toner image, which smaller toner is tighter held to the image member.

SUMMARY OF THE INVENTION

It is an object of the invention to provide an image forming apparatus generally of the type described in which two or more toner images are formed in the same frame or area of an image member without fixing or transferring the first toner image in which the problems of movement of the first toner image into the second image and/or scavenging have been reduced.

This and other objects are accomplished by an image forming apparatus having an image member and means for forming first and second toner images on the same area or frame of the image member without fixing or transferring the first toner image. The second image forming means includes means for applying toner to an electrostatic image. A device for removing toner particles associated with the first image, which particles are less well held to the image member, is positioned after the first toner image forming means and before the means for applying toner to the electrostatic image.

According to a preferred embodiment, the means for removing less well held toner can be similar to any of a number of traditional toner cleaning devices, providing the removing means does not remove more of the first toner image than desired. A preferred example includes a biased cleaning roller that is narrowly spaced from the first image and has a bias chosen to attract only toner less strongly held to the image member while leaving that more strongly held. Alternatively, a vacuum toner cleaning device can be tuned to clean off the loose toner more likely to be scavenged or migrate from the image area without disturbing the bulk of the first toner image.

Typically, because of the voltages involved in the electrostatic image and variations in the charge on the toner particles (some are even oppositely charged from the others), some toner particles are less tightly held by the image member than others. These particles are the ones most likely to be scavenged by the second toning station. Using the invention, many of these particles are removed before the second station is reached.

Using the preferred embodiments, sharper defined images (from less toner migration) can be produced with less toner from the first image contaminating the second toner station. This is especially useful when the first image is of a darker color than the second image.

DESCRIPTION OF THE PREFERRED EMBODIMENTS

Figure 1:
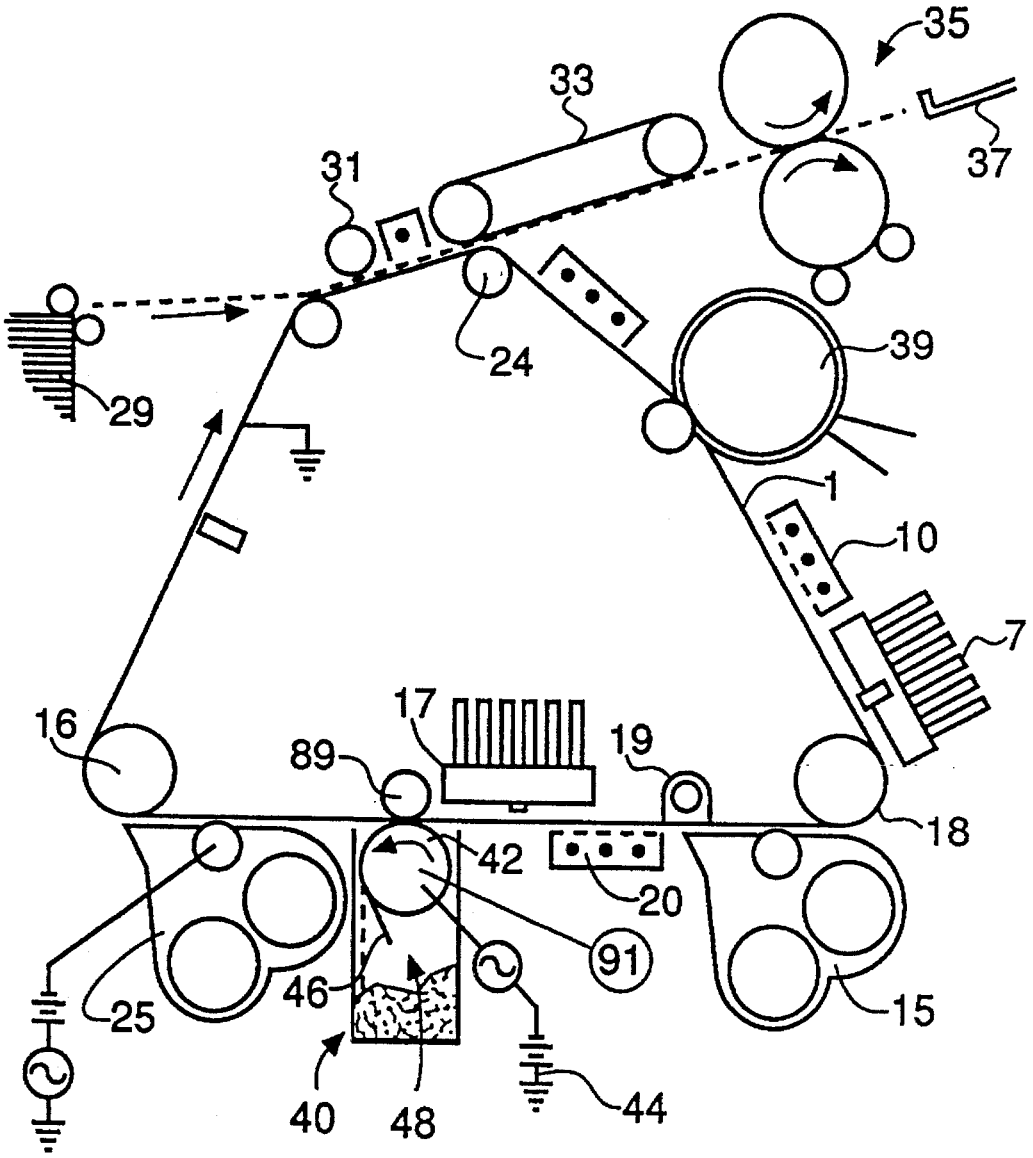
FIGS. 1 and 2 are side schematics of alternative image forming apparatus.
Figure 2:
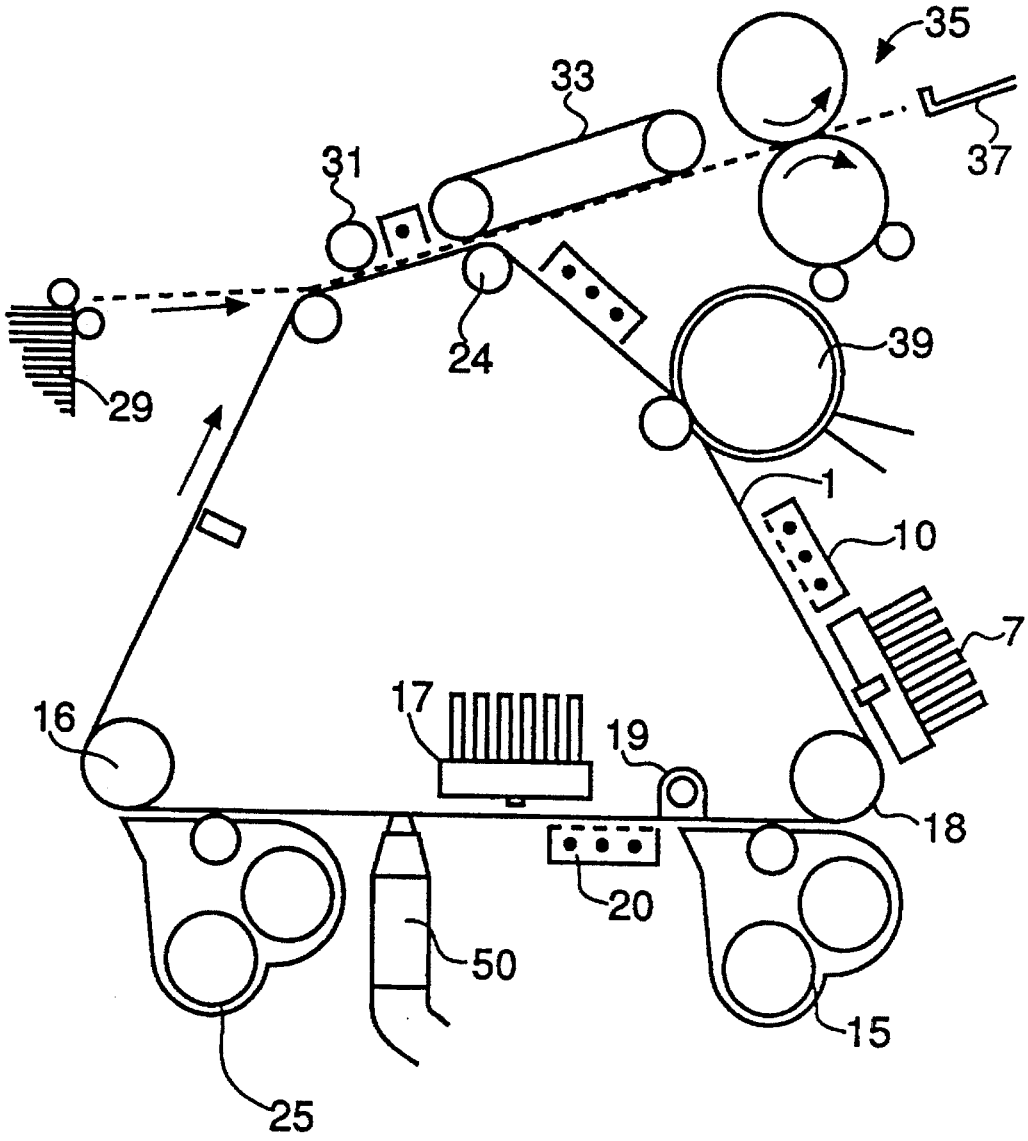

Both FIGS. 1 and 2 show an image forming apparatus of the type in which the invention is particularly usable. According to FIGS. 1 and 2, an image member, for example, an endless photoconductive belt 1, is trained about a series of rollers, including rollers 16, 18 and 24 to move through an endless path past a series of stations to form combined toner images by a known electrophotographic process. More specifically, image member 1 is charged by a first charging station 10 and imagewise exposed by a first LED printhead 7 to create a first electrostatic image. Other means can be used to form such electrostatic images including nonelectrophotographic means such as imagewise charge deposition. The first electrostatic image is toned by toning station 15 containing dry toner of a first color to create a dry, first color, first toner image on image member 1.

Although not absolutely necessary, for best results, the image member is, again, charged by a second charging station 20 to even the charge across the image member. Some reduction in scavenging may be obtained if the first toner image is exposed to discharging radiation by an erase lamp 19 before reaching second charging station 20. The image member is, again, exposed by a second exposure station 17 to create a second electrostatic image. The second electrostatic image is toned by a second toning station 25 containing dry toner of a second color to create a dry, second color, second toner image in the same area as the first toner image. If the first and second colors are different, the area now contains a two color image. This process could be repeated with another set of stations to create a third toner image to form a three color image and so forth.

The two color image proceeds to a transfer station 31 where it is transferred to a receiving sheet fed out of a receiving sheet supply 29. The receiving sheet is separated from image member 1 at roller 24 and transported by a transport 33 to a fuser 35 where it is fixed and ultimately deposited in output tray 37. Image member 1 is cleaned at a cleaning station 39 for reuse in the continuous process.

Although this apparatus can use charged area development and it can expose with conventional optical exposure, commercial applications have thus far used discharged area development and electronic exposure, which are preferred. For example, if the charge laid down by chargers 10 and 20 is a negative charge, then the toners applied by stations 15 and 25 are also negatively charged and adhere, therefore, to the exposed portions of the image. U.S. patent application Ser. No. 08/065,246 to Guth et al, cited above is hereby incorporated by reference herein. In that application, it is explained that the discharged area development aspect may cause the toner migration problem spoken of earlier. We believe that toner adhering to the edge of a discharged area in the first electrostatic image moves into a discharged area of the second electrostatic image adjoining before that area is toned because of the voltage level of that area compared to other charged areas in the neighborhood. This toner migration occurs at or just after the second exposure at station 17.

We have also found that somewhat less scavenging occurs if the charge on the image member 1 after toning station 15 is dissipated with a rear erase lamp 19 prior to recharging with charger 20. This phenomenon is relatively modest but does appear to form a better electrostatic bond between the first toner image and the image member in a process using discharged area development. Scavenging is also reduced if the second toning step carried out by station 25 uses a brush that is slightly separated from the image. For discharged area toning, a DC bias slightly less than the background portions of the image is applied to the station. For projection toning, an AC bias is also applied between the station and the image member.

To further reduce these problems of migration and scavenging, the image forming apparatus shown in both FIGS. 1 and 2 includes a device for removing toner particles associated with the first image that are less tightly held to image member 1. Known electrophotographic cleaning devices can be used, providing they do not clean the entire first toner image from the image member.

According to FIG. 1, the removing device is a roller cleaner 40. Roller cleaner 40 includes a roller 42 which is rotated by a motor 91 at the same speed and direction as image member 1. It is biased by an electrical power source 44 to mildly attract toner to it. Toner so attracted is skived by a skive blade 46 into a sump 48. Preferably, it is coupled to a backing roller 89 to be slightly spaced from image member 1 to not disturb the image mechanically. A suitable spacing is 0.5–1 mm, although larger spacings also are effective. Skived toner can be recirculated to first toning station 15 or emptied by a serviceperson or operator. The roller can be of any material capable of forming a field, for example, silicone rubber or aluminum.

The bias on roller 42 must be empirically determined from scavenging and image sharpness and density observations. If both the first electrostatic image and the first toner image particles are negative in charge, the bias on roller 42 preferably has a DC component that is negative in order not to reduce substantially the density of the first toner image. For example, if the electrostatic image varies from −100 V to −600 V, image to background, roller 42 is preferably biased between ground and −450 volts. It is preferably somewhat more attractive to the toner than is the second development station 25. Thus, if the bias on the second station is −500 volts, a good DC bias on roller 42 is −450 volts. An AC component helps in the attraction process and allows a less positive DC bias to be effective. Good results have been obtained across a 1 mm gap with an image having a background at −600 volts with the following biases: 3 kV-AC(1.5 kHz) at −450 V-DC and 3 kV-AC(0.8 kHz) at −200 V-DC.

Referring to FIG. 2, a toner particle removing device can be a vacuum cleaner 50 positioned to create a light vacuum in the area of the image as it passes after exposure by LED printhead 17 and prior to toning by toning station 25. Toner removed by station 50 can also be recycled to station 15 or deposited for removal.

U.S. Pat. No. 4,797,708 to Kasiske et al, granted Jan. 10, 1989, shows such a vacuum device for removing clumped toner deposits on a similar image member in the presence of a toner image yet to be transferred. This patent is hereby incorporated by reference in this application. Again, the force of the vacuum must be determined empirically from image and scavenging observations.

Both of the devices shown in FIGS. 1 and 2 must be tuned for the parameters of the image forming apparatus in which applied. When done, scavenging is eliminated by eliminating the particles that would be scavenged by toning station 25. Migration is reduced by also eliminating the particles that have a tendency to move or, preferably, have moved into the surrounding area. Note that both of these effects could be obtained, to a lesser degree, by placing the removing station upstream in the order. For example, it could be placed between charging station 20 and exposing station 17 or even between toning station 15 and charging station 20. However, for best results, the removing device should be placed after exposing station 17 and before toning station 25. Note that even if the removing device removes some of the first toner image that would not scavenge, the tradeoff of a somewhat less dense image for no scavenging or edge fuzziness may still be desirable.

If a third set of stations is used to apply a third color, then another removing device is appropriately positioned prior to the toning station in that set of stations.

The invention has been described in detail with particular reference to a preferred embodiment thereof, but it will be understood that variations and modifications can be effected within the spirit and scope of the invention as described hereinabove and as defined in the appended claims.

I claim:

1. Image forming apparatus for forming a combined toner image, said apparatus comprising:

an image member movable through an endless path, means for forming a first electrostatic image on the image member, means for applying a first dry toner to the first electrostatic image to form a first toner image on the image member electrostatically held to the image member, said first toner image including toner particles that are less tightly held to the image member, means for forming an electrostatic image in the same frame or area of the image member containing the first toner image, means for applying a second toner to the electrostatic image to form a second toner image without fixing or transferring the first toner image, and means positioned between the means for forming the first toner image and the means for applying the second toner to the electrostatic image for removing at least some of the toner particles associated with the first toner image that are held less tightly to the image member.

2. Image forming apparatus comprising:

an image member, first means for applying a charge of a first polarity to the image member, means for imagewise exposing the image member to create a first electrostatic image of the first polarity, means for applying toner of a first color and a first polarity to the first electrostatic image to form a first toner image, second means for applying a charge of a first polarity to the image member, second means for imagewise exposing the image member to create a second electrostatic image of the first polarity, means for removing loose toner from the image member after exposure to create the second electrostatic image, means for applying a second toner of a second color different from the first color to the second electrostatic image to create a two color image after removal of the loose toner from the image member.

3. Image forming apparatus according to claim 2 wherein said means for removing includes a roller slightly spaced from the first toner image which roller is biased to create an electrical field lightly urging toner in the image toward the roller.

4. Image forming apparatus according to claim 3 wherein the bias includes an AC component.

5. Image forming apparatus according to claim 3 wherein the means for applying a second toner includes means for applying a bias to the applying means having a DC component urging toner toward image portions of the second electrostatic image and away from background portions and wherein the bias on the roller has a DC component that creates a stronger attractive force to the first toner than does the DC component of the bias on the means for applying a second toner.

6. Image forming apparatus according to claim 2 wherein said means for removing includes means for applying a vacuum to the image member to remove toner not substantially electrostatically held to said image member.

* * * * *